US005794716A

United States Patent [19]

White

[11] Patent Number: 5,794,716

[45] Date of Patent: Aug. 18, 1998

[54] VIBRATORY SYSTEMS FOR DRIVING ELONGATE MEMBERS INTO THE EARTH IN INACCESSIBLE AREAS

[75] Inventor: John L. White, Kent, Wash.

[73] Assignee: American Piledriving Equipment, Inc., Kent, Wash.

[21] Appl. No.: 669,717

[22] Filed: Jun. 26, 1996

[51] Int. Cl.[6] ..... E21B 7/24

[52] U.S. Cl. ..... 173/189; 173/49; 173/193

[58] Field of Search ..... 173/49, 39, 42, 173/44, 186, 187, 188, 189, 191, 193; 405/231, 232

[56] References Cited

U.S. PATENT DOCUMENTS

| | | | |
|---|---|---|---|
| 3,786,874 | 1/1974 | Jodet et al. | 173/49 |
| 4,067,369 | 1/1978 | Harmon | 173/49 |
| 4,312,413 | 1/1982 | Loftis | 173/189 |
| 4,375,927 | 3/1983 | Kniep | 173/49 |
| 4,603,748 | 8/1986 | Rossfelder et al. | 173/49 |
| 4,637,475 | 1/1987 | England et al. | 173/193 |
| 5,117,925 | 6/1992 | White | 173/162.1 |
| 5,263,544 | 11/1993 | White | 173/162.1 |
| 5,544,979 | 8/1996 | White | 405/232 |

*Primary Examiner*—Scott A. Smith

*Attorney, Agent, or Firm*—Michael R. Schacht; Hughes & Schacht, P.S.

[57] ABSTRACT

A system for allowing elongate members such as piles, caissons, and casings to be driven into the earth at inaccessible locations. The system comprises a structural assembly having a support assembly and a bracing assembly. The structural assembly is arranged on a ground engaging assembly. The bracing assembly engages the caisson as it is being driven to make sure that it is plumb as it is being driven and when it is subsequently in the earth. The ground engaging assembly is adjustable to alter the orientation of the structural assembly to maintain the caisson in a plumb orientation. The bracing assembly comprises a guide portion and an extension portion. The extension portion may be retracted and extended relative to the support assembly. The system employs a conventional vibratory hammer to drive the elongate member. The system may also include a helicopter to lift the various components and the elongate member to the desired location.

21 Claims, 9 Drawing Sheets

VIBRATORY SYSTEMS FOR DRIVING ELONGATE MEMBERS INTO THE EARTH IN INACCESSIBLE AREAS

TECHNICAL FIELD

The present invention relates to vibratory systems for driving elongate members into the earth and, more particularly, to such vibratory systems that allow elongate members to be driven at locations that are inaccessible because they are remote and/or sensitive.

BACKGROUND OF THE INVENTION

In the construction industry, it is often necessary to insert elongate members into the earth. Such elongate members may be solid piles or hollow, generally cylindrical bodies referred to as caissons or, in the context of drilling, as casings.

Such elongate members are driven into the earth for many reasons. Piles are often driven into lake or river beds as part of a pier structure or the like. Caissons are often inserted into the earth during new construction as part of a foundation for a structure. Casings are employed when drilling a hole to prevent the earth from collapsing into the hole as it is drilled.

In this application, the term "caisson" will be used to refer to any elongate member that is driven into the earth, including traditional caissons, solid piles, and casings used in drilling operations.

To insert a caisson into the earth, a large driving force must be applied thereto. Often, vibratory devices are employed to introduce a vibratory force along the axis of the caisson during the driving process. The combination of a static driving force with a dynamic vibratory force is usually sufficient to overcome the earth's resistance and allow the caisson to be inserted therein.

Normally, the vibratory device is incorporated into a vibratory system including a crane for suspending the vibratory device, a suppresser for preventing vibratory forces from being transmitted to the crane, a power pack for providing hydraulic power to the vibratory device, and a clamping system adapted to connect the vibratory device to the particular elongate member being driven. The weight of the vibratory device, suppresser, and clamping system create the static driving force required.

In certain situations, the caisson must be driven in a location that is relatively inaccessible to the entire vibratory system as described above. In particular, the use of such systems may be impractical or expensive if the caisson is be driven in a location not serviced by road or in an environmentally sensitive area.

In the case of a remote location, a road or the like may be constructed to allow the vibratory system to be trucked to the remote location. This approach yields satisfactory results in many situations but can be expensive because of the road work involved. When a caisson is to be driven in environmentally sensitive areas such as wetlands or the like, governmental regulations may preclude the building of a road to allow trucks to transport the remote location. Or if such a road may be constructed, the road must later be removed and the area returned to its original condition. This process is usually very expensive.

One approach that has been employed in remote locations is to use a helicopter to transport the vibratory system and caisson to the remote location. The power pack is brought in first, after which the caisson and vibratory device are brought in. The power pack is connected to the vibratory device and operated to drive the caisson into the earth.

The use of a helicopter obviates the need to construct and/or remove an access road. But, without a crane, it is difficult to keep the vibratory device plumb as it is driven into the earth. The helicopter may be used for this purpose, but helicopters are not particularly suited for this type of work and are normally quite expensive.

The need thus exists for a system for driving caissons into the earth at inaccessible locations without the need to construct an access road and in a manner that allows the caisson to kept plumb as it is driven into the earth without use of a helicopter.

OBJECTS OF THE INVENTION

From the foregoing, it should be clear that one primary object of the present invention is to provide an improved vibratory system for driving piles at inaccessible, remote, or sensitive locations.

A further object of the invention is to provide a vibratory system having a favorable combination of the following characteristics:

(a) obviates the need to construct a road to reach the location at which the caisson is to be inserted into the earth;

(b) allows the use of standard power packs, vibratory devices, and clamping assemblies;

(c) allows the caisson to maintained in a plumb orientation as it is driven and/or returned to plumb if necessary;

(d) is relatively inexpensive to operate;

As will become clear from the following detailed discussion, these and other objects are achieved by the caisson driving system of the present invention.

SUMMARY OF THE INVENTION

The present invention is a system for driving elongate members such as piles or the like in a desired location that is relatively inaccessible. The system of the present invention basically comprises a vibratory apparatus, a structural assembly, and a ground engaging assembly. The structural assembly comprises a support portion and a bracing portion. The ground engaging assembly spaces the structural assembly from the ground adjacent to the desired location. The bracing portion of the structural assembly engages the elongate member being driven to keep the elongate member in a plum orientation.

The ground engaging assembly may be made extensible or movable to change the orientation of the structural assembly relative to the earth. The bracing assembly can be adapted to engage the elongate member such that, as the orientation of the structural assembly is changed, the direction of the axis of the elongate member relative to the earth is changed. Thus, if the elongate member is not vertical, it can be moved back into a vertical position by operation of the ground engaging assembly. In this case, the ground engaging assembly may comprise a plurality of pneumatic jacks extending between the structural assembly and the ground.

The bracing assembly may comprise a fixed portion, an extension portion, and a pneumatic cylinder. The fixed portion is rigidly attached to the support portion. The pneumatic cylinder is arranged to extend and retract the extension portion relative to the fixed portion. The bracing member may thus be moved into and out of position adjacent to the elongate member and can be used to force the elongate member into a vertical position in some situations.

The bracing assembly may also comprise a cage assembly adapted to surround the caisson. The cage assembly would preferably comprise one or more gate portions that may be opened to allow the elongate member to be placed into and removed from a cage chamber defined by the cage assembly.

The vibratory apparatus conventionally comprises a vibratory portion and a power pack portion connected by hydraulic hoses. The power pack portion of the vibratory apparatus may be mounted onto or formed as an integral part of the support portion for ease of transportation and use.

The present invention may be embodied in a method comprising the steps of transporting the structural assembly with the power pack portion to the desired location by helicopter, transporting the elongate member and vibratory portion to the location by helicopter, and supporting the elongate member as it is driven using the structural assembly.

DETAILED DESCRIPTION

Figure 1:
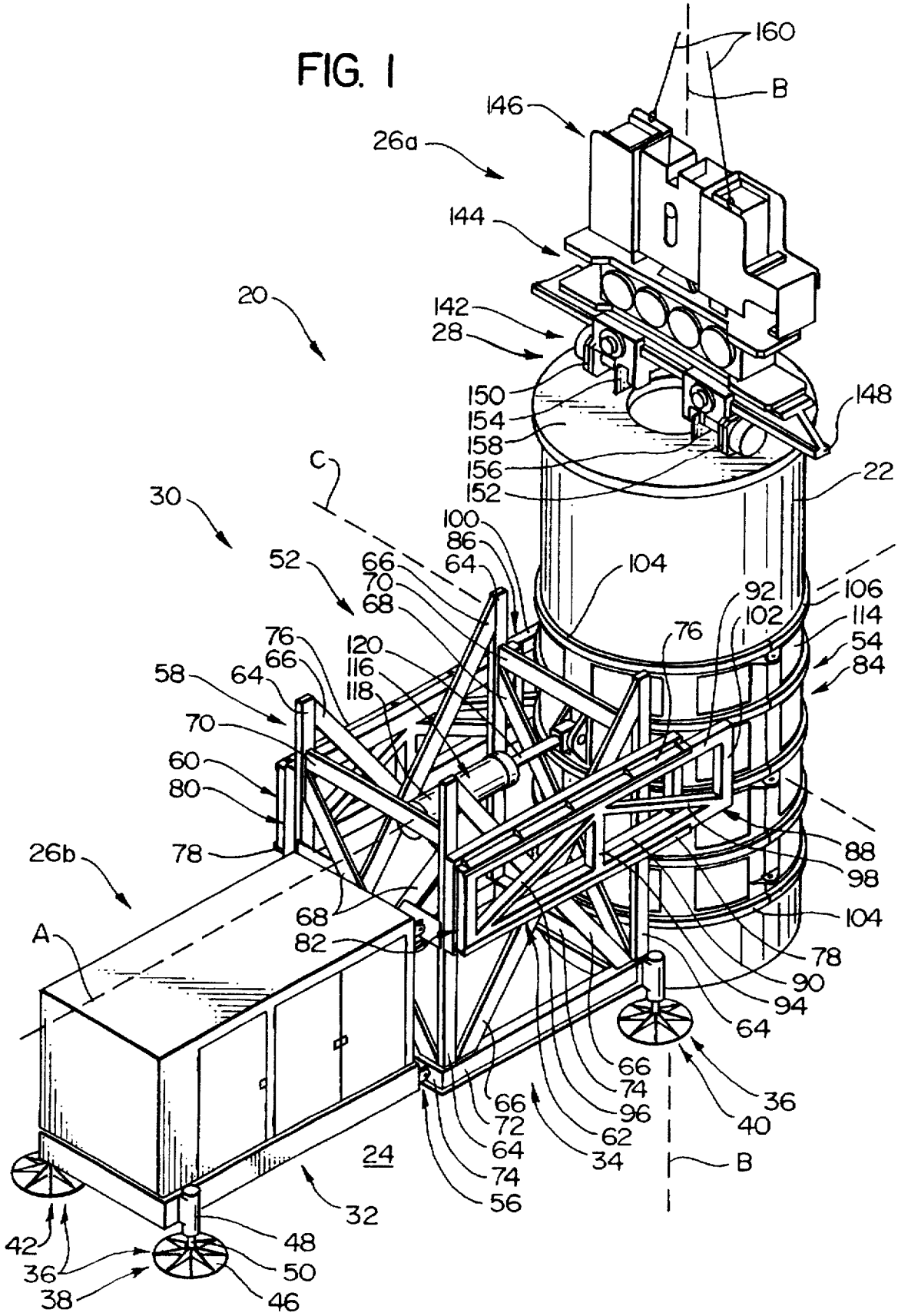
FIG. 1 is a perspective view of vibratory system 20 of the present invention.

Referring now to the drawing, depicted at 20 in FIG. 1 is a caisson driving system constructed in accordance with, and embodying, the principles of the present invention. The system 20 is adapted to drive a caisson 22 into the earth 24.

The system 20 basically comprises a vibratory system 26 including a vibratory portion 26a and a power portion **26*b*, a clamp assembly for fixing the vibratory portion 26*a* of the vibratory system 26 onto the caisson 22, and a structural assembly 30. The structural assembly 30 comprises a support assembly 32 and a bracing assembly 34. A ground engaging assembly 36 spaces the structural assembly 30 from the earth 24**.

The bracing assembly 34 is adapted to engage the caisson 22. As the vibratory system 26 applies vibratory forces to the caisson 22 to drive the caisson 22 into the earth 24, the structural assembly 30 maintains the caisson 22 in a desired orientation with respect to the earth 24 as these vibratory forces are applied thereto.

Figure 4A:
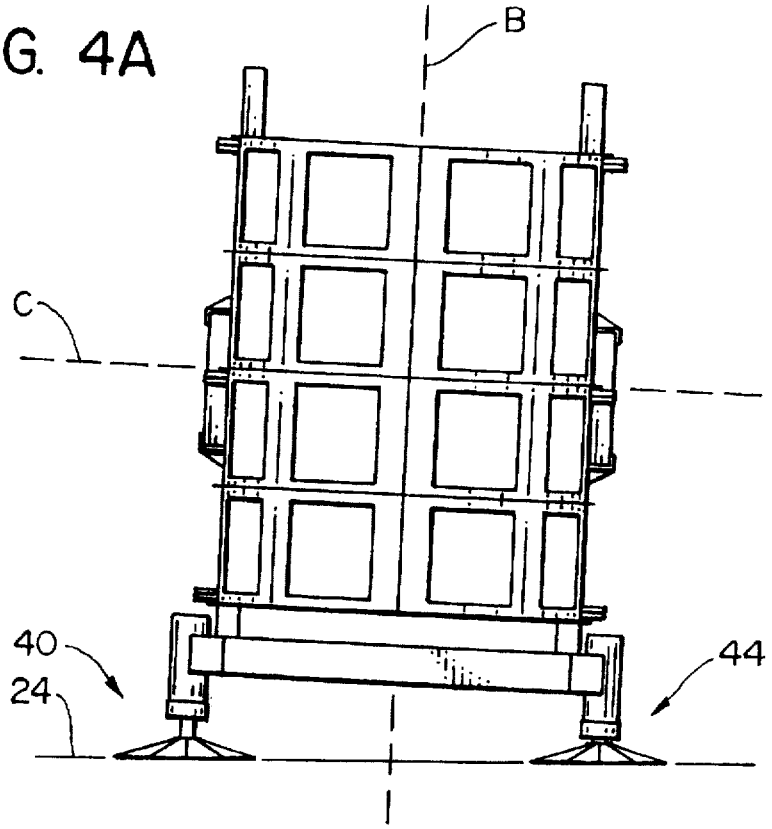
Figure 4B:
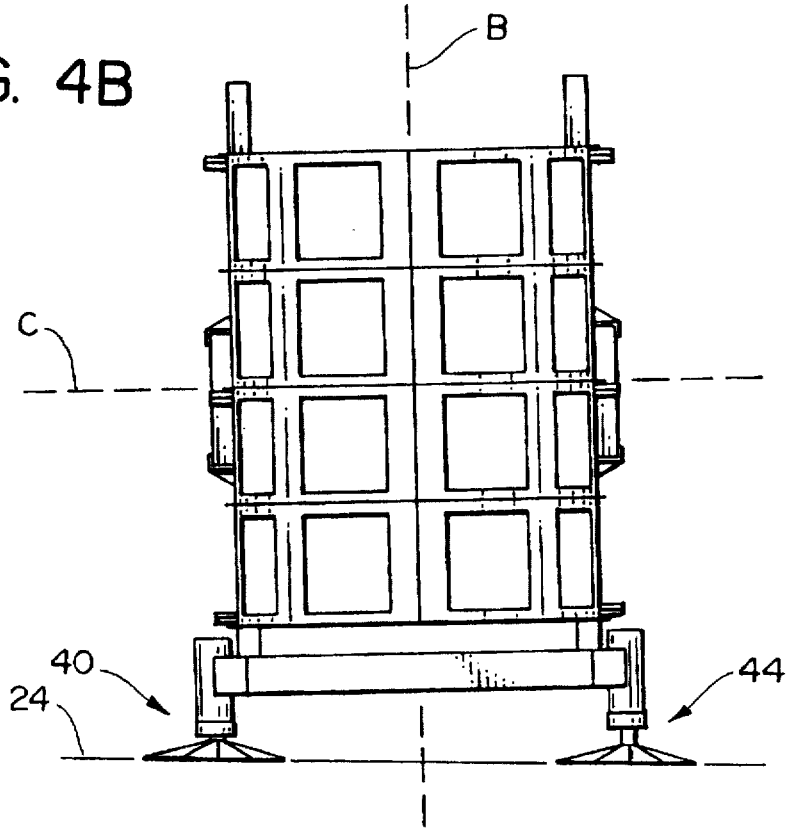

The ground engaging assembly 36 forms an adjusting means that allows a position of the structural assembly 30 relative to the earth 24 to be adjusted or altered. In particular, the ground engaging assembly 36 comprises first through fourth jack assemblies 38, 40, and 42 (FIGS. 4A and 4B). These jack assemblies 38–44 are identical and each comprises a ground plate 46 adapted to engage the ground 24, a cylinder 48 rigidly fastened to the structural assembly 30, and a piston 50 connected between the cylinder 48 and the ground plate 46. By introducing hydraulic fluid into the cylinder 48, the piston 50 is forced out of the cylinder 48 to effectively lengthen the jack assemblies 38–44. By allowing hydraulic fluid to flow out of the cylinders 48, the length of these jack assemblies 38–44 can effectively be shortened.

The effect of these jack assemblies 38–44 is shown in FIGS. 3A, 3B, 4A, and 4B. To help explain these figures, shown in FIGS. 1, 3A, 3B, 4A, and 4B are a longitudinal axis A, vertical axis B, and lateral axis C of the system 20. The vertical axis B also corresponds to the longitudinal axis of the caisson 22. The caisson 22 is driven along the vertical axis B.

Figure 3A:
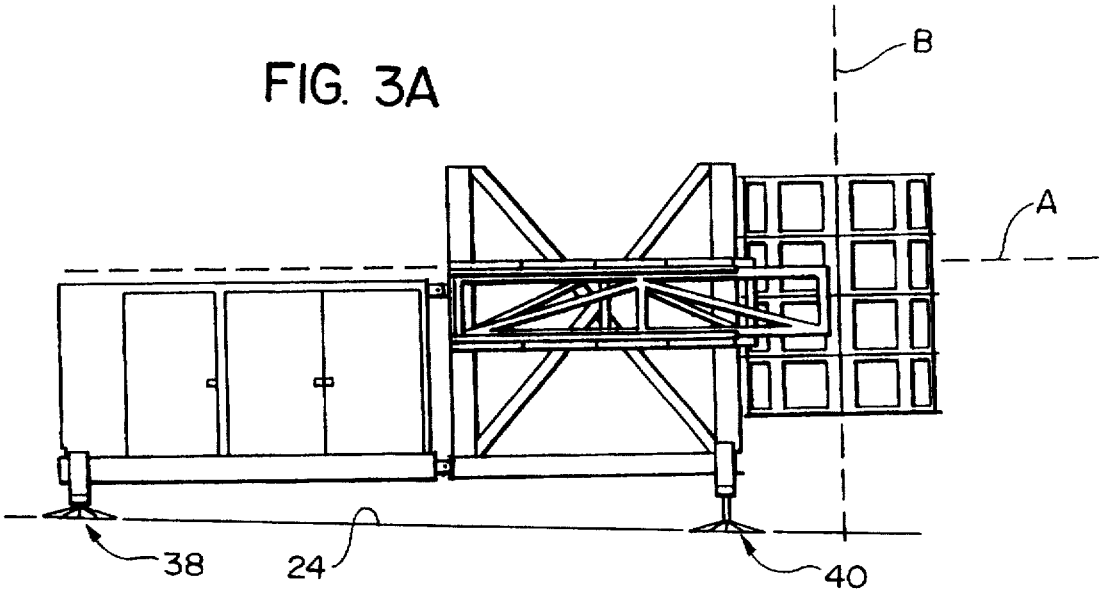
FIGS. 3A, 3B, 4A, and 4B depict the use of ground engaging jack assemblies to change the orientation of the caisson being supported by the present invention.
Figure 3B:
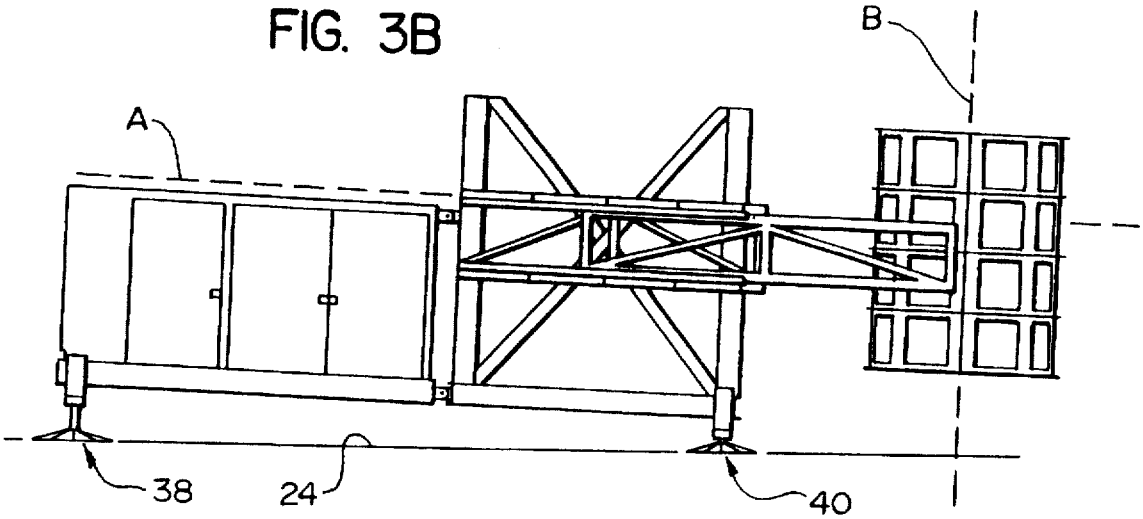

Referring now to FIGS. 3A and 3B, it can be seen that the angles between the longitudinal axis A and vertical axis B are different from FIG. 3A than from FIG. 3B. This change in angles is accomplished by a change in effective length of jacks 38–44. In particular, the overall length of the jack assembly 38 is shorter in FIG. 3A than in FIG. 3B. Conversely, the overall length of jack assembly 40 is longer in FIG. 3A than in FIG. 3B.

A similar change in the angles between the lateral axis C and the vertical axis B may be obtained as shown in FIGS. 4A and 4B. The jack assembly 40 in FIG. 4A is longer than in FIG. 4B, while the jack assembly 44 is longer in FIG. 4B than in 4A.

By comparing FIGS. 3A, 3B, 4A, and 4B, one can see that the angle of the vertical axis B with respect to the ground 24 can be significantly changed by operation of the jack assemblies 38–44. Thus, the jack assemblies 38–44 can be employed to plumb the vertical axis B and thus the caisson 22 in contact with the bracing assembly 34.

Figure 2A:
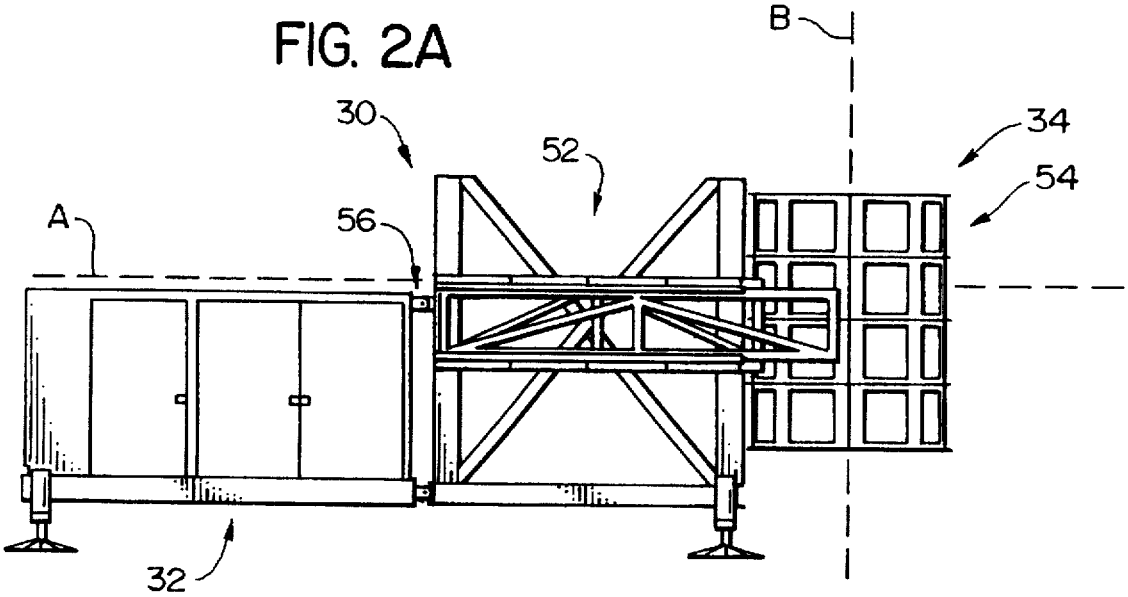
FIGS. 2A and 2B depict extension and retraction of the cage assembly of the present invention.
Figure 2B:
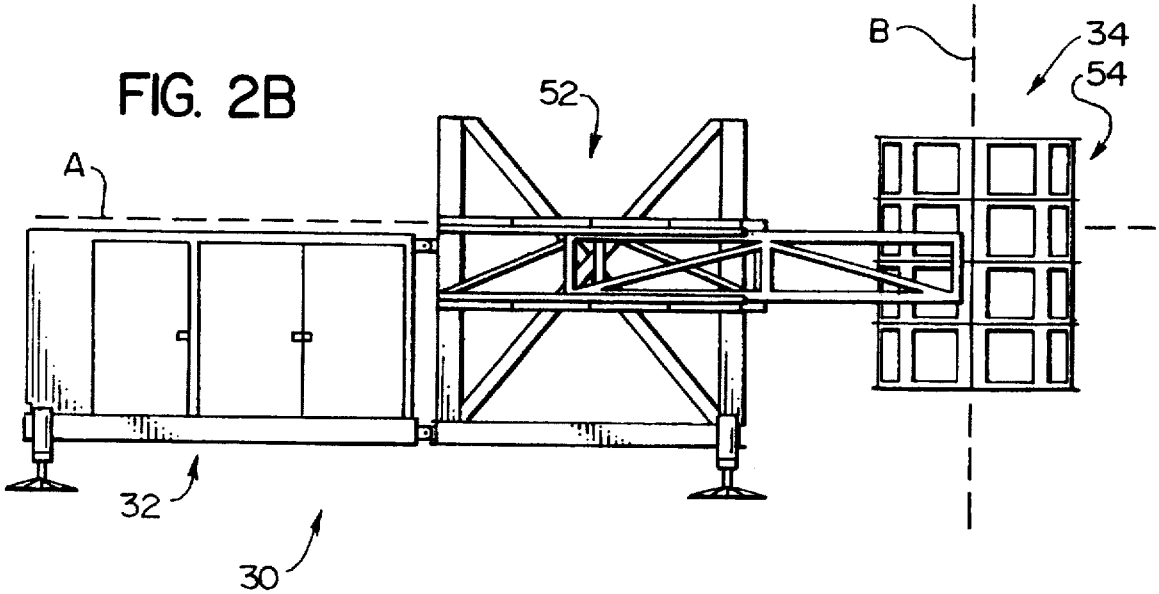

Referring now to FIGS. 2A and 2B, these figures show that the bracing assembly comprises a guide assembly 52 and an extension assembly 54. The guide assembly 52 is securely attached to the support assembly 32 by connecting assembly 56. The guide assembly 52 slideably engages the extension assembly 54 such that the extension assembly can move away and towards the guide assembly 52 (and thus the support assembly 32) along the longitudinal axis A. In particular, the extension assembly 54 is shown in its retracted position in FIG. 2A and in its extended position in FIG. 2B.

A comparison of FIGS. 2A and 2B shows that the vertical axis B is spaced further from the support assembly 32 in the extended position than in the retracted position. This feature of the present invention can be used to plumb the vertical axis B and, as will be explained in further detail below, to facilitate driving of the caisson 22 completely into the earth 24.

The guide assembly 52 basically comprises a structural frame 58, first side rails 60, and second side rails 62. The structural frame 58 comprises four corner posts 64, four side braces 66, internal braces 68, two upper horizontal braces 70, two side horizontal braces 72, and two internal horizontal braces 74. These members 66–74 are connected in a manner that creates a rigid, stable, box-like structure appropriate for bearing the loads encountered while plumbing and driving the caisson 22.

The side rails 60 and 62 are attached in parallel on opposing sides of the frame structure 58. Each of the rails 60 and 62 comprises an upper rail member 76 and a lower rail member 78. The rail members 76 and 78 define channels 80 and 82.

The extension assembly 54 comprises a cage assembly 84 adapted to encircle the caisson 22 and first and second channel assemblies 86 and 88 are adapted to be received within the channels 80 and 82, respectively. The channel assemblies 86 and 88 are rectangular in overall configuration and slightly larger in the direction of the longitudinal axis A than the channels 80 and 82. Each of the rail members 86 and 88 is identical and comprises upper and lower rigid members 90 and 92, a center post 94, and angle braces 96 and 98. These members are dimensioned and assembled in a manner appropriate for bearing the loads encountered while plumbing and driving the caisson 22. Distal ends 100 and 102 of these channel assemblies 86 and 88 are rigidly connected to the cage assembly 84.

Figure 5A:
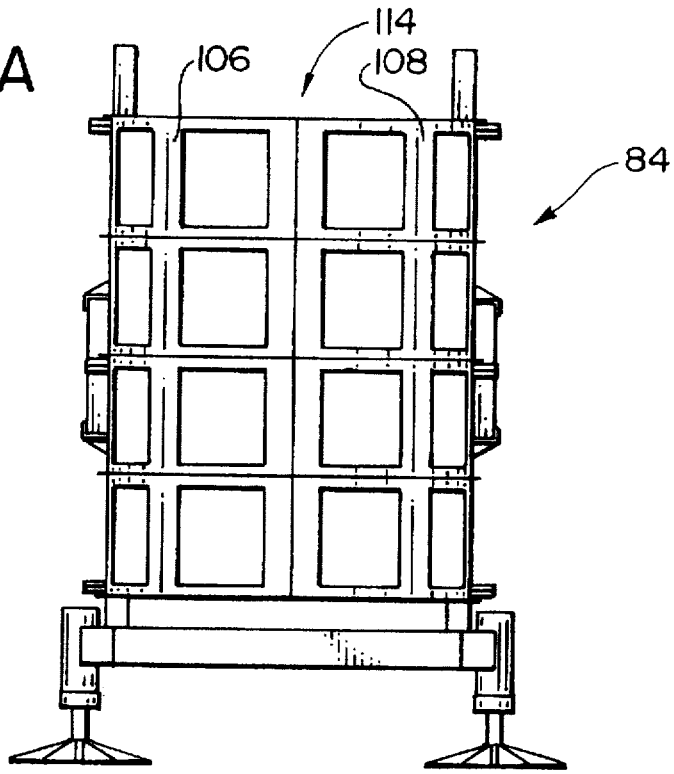
FIGS. 5A and 5B depict the opened and closed position of the gate assembly of the present invention.
Figure 5B:
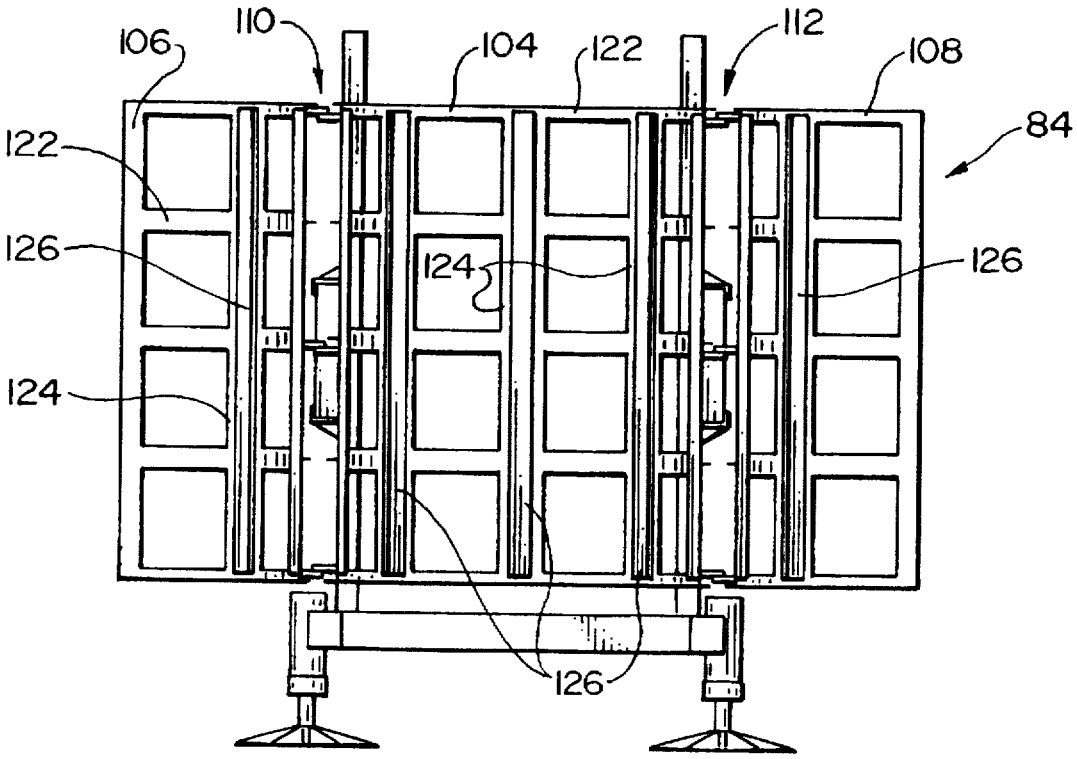

Referring now to FIGS. 5A and 5B, the cage assembly 84 comprises a fixed portion 104 securely attached to the distal ends 100 and 102 of the channel assemblies 86 and 88 and first and second gate members 106 and 108 rotatably attached to the fixed member 104 by hinge assemblies 110 and 112. The gate members 106 and 108 may thus rotate between a closed position as shown in FIG. 5A and an open position as shown in FIG. 5B.

In the closed position shown in FIGS. 1 and 5A, the gate members 104, 106, and 108 define a gate chamber 114 sized and dimensioned to encircle a portion of the caisson 22. The ability of the gate members 106 and 108 to move into the open position shown in FIG. 5B allows the caisson 22 to be placed into the gate chamber 114 by displacing the extension assembly 54 relative to the caisson 22 rather than by moving the caisson 22 into the chamber 114.

To accomplish the movement of the extension assembly 54 between the retracted and extended position shown in FIGS. 2A and 2B, a hydraulic assembly 116 is provided assembly hydraulic assembly 116 comprises a cylinder 118 securely attached to the frame structure 58 and a piston member rigidly connected to the fixed cage member 104. By introducing pressurized hydraulic fluid into appropriate chambers in the cylinder 116, the piston member 120 can be forced into or out of the cylinder 118. Because the hydraulic assembly 116 is connected as described above between the frame structure 58 and the fixed gate member 104, the hydraulic assembly 116 moves the extension assembly 54 between the retracted and extended positions shown in FIGS. 2A and 2B.

Referring now for a moment back to FIG. 5B, it can be seen that the cage members 104, 106, and 108 comprise a rigid, ladder-like structure including a series of vertical members 122 and horizontal members 124. Mounted on the inside of each of the vertical members 124 are pad members 126. The pad members 126 are made of a somewhat resilient material that will reduce the likelihood that engagement of the members 104, 106, and 108 with the caisson 22 will result in damage to the caisson. The exemplary pads 126 are made of wood, but any resilient material may be used that has a somewhat slick surface that will not impede passage of the caisson 22 through the cage chamber 114.

Figure 6:
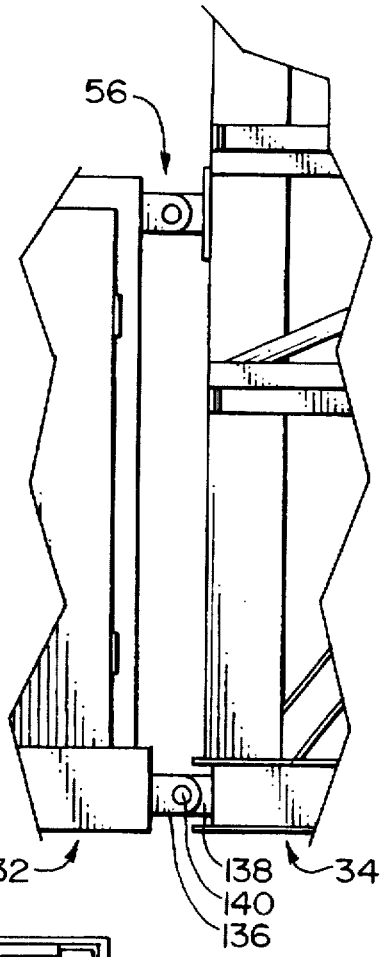
FIGS. 6 and 7 show details of the connecting assembly of the system of the present invention.
Figure 7:
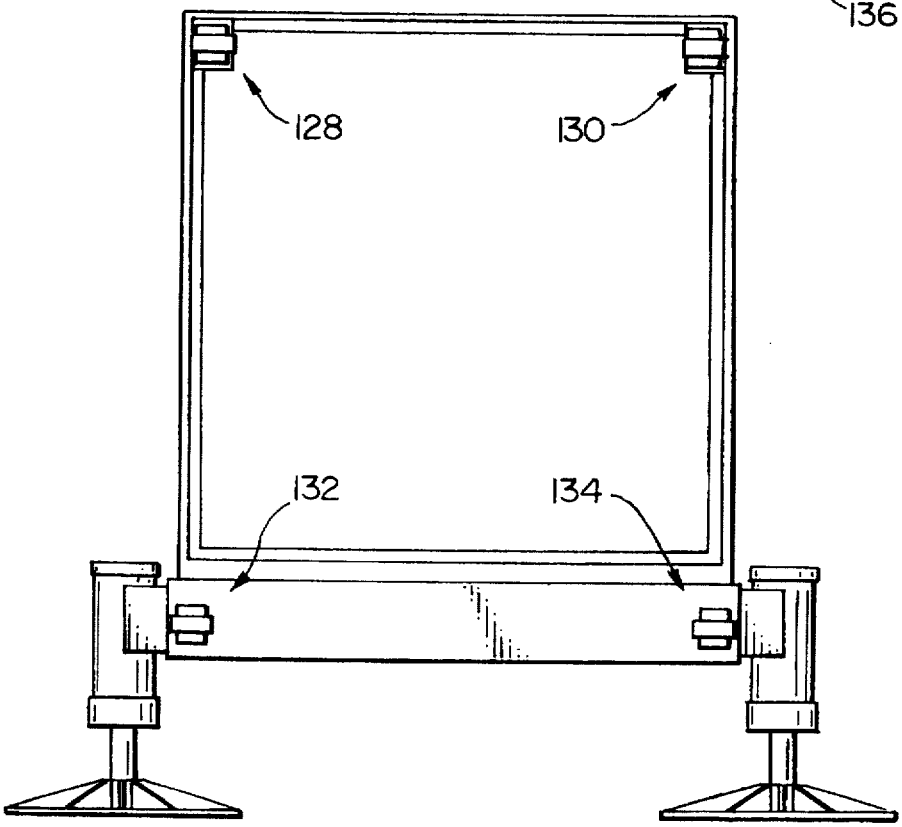

Referring now to FIGS. 6 and 7, depicted therein in more detail is the connecting assembly 56 employed to connect the support assembly 32 to the bracing assembly 34 to form the structural assembly 30. The connecting assembly 56 connects the assemblies 32 and 34 at four points identified by reference characters 128, 130, 132, and 134. At each of these locations, a first flange 136 extends from the support assembly and a second flange 138 extends from the bracing assembly 34. A hole is formed in each of these flanges 136 and 138 that is adapted to snugly receive a pin 140. By aligning the holes in the flanges 136 and 138 and inserting the pin 140, relative movement along any of the axes A, B, and C described above is prevented. By providing four attachment points and spacing these points such that the longitudinal axes of these pins do not all lie in the same line, a rigid connection is formed between the assemblies 32 and 34.

As briefly described above, the vibratory system 26 comprises a vibratory portion **26*a* and a power portion 26*b*. The power portion 26*b* may be a conventional power pack that is placed into a separate rigid frame forming the support assembly 32 or may be an integral part of this assembly 32. In the exemplary system 20, the power pack portion 26*b* of the vibratory system 26 is integrally formed as part of the support assembly 32**.

The vibratory portion **26*a* comprises a clamping assembly 142, a vibratory assembly 144, and a suppresser assembly 146**.

The clamping assembly 142 comprises a beam member 148 from which clamps 150 and 152 are suspended. These clamps 150 and 152 rigidly engage flanges 154 and 156 rigidly welded to an upper end wall 168 of the caisson 22.

The vibratory assembly 144 comprises eccentrically mounted weights that are rotated to generate vertical vibratory forces in a conventional manner. The vibratory assembly 144 is rigidly connected to the beam 148.

The suppresser assembly 146 is rigidly connected to the vibratory assembly 144. Cables 160 are attached to the suppresser assembly 146 to allow the vibratory portion **26*a* to be suspended from a helicopter or the like. The suppresser assembly 146 is configured to absorb the vibratory forces generated by the vibratory assembly 144 and prevent these forces from being transmitted to the cables 160**.

The power pack portion **26*b* of the vibratory system 26 supplies hydraulic fluid appropriate for operating the jacks 38–44, the hydraulic assemblies 116, the clamping assembly 142, and the vibratory assembly 144. Ordinarily, the power pack portion 26*b* comprises a motor (not shown) to make the vibratory system 26** self-contained.

Referring now to FIGS. 8A–8L, the method of using the system 20 will be described in further detail.

Figure 8A:
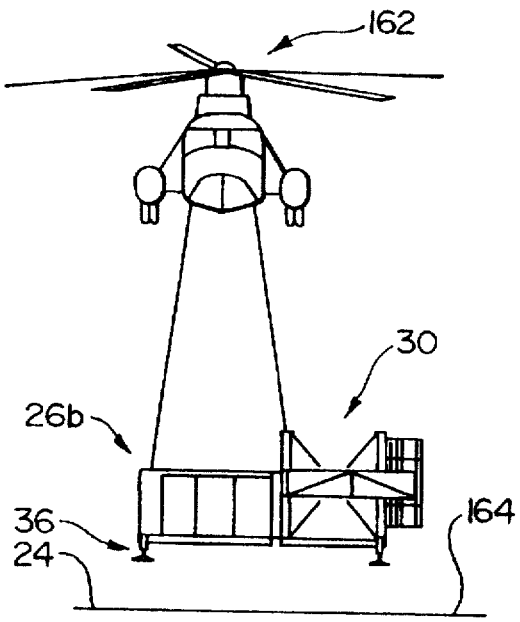
FIGS. 8A–8L depict the method of using the system 20.

Referring initially to FIG. 8A, a helicopter 162 is used to transport the structural assembly 30, power pack portion **26*b*, and a ground engaging assembly 36 to a desired location of the earth 24 represented by reference character 164**.

Figure 8B:
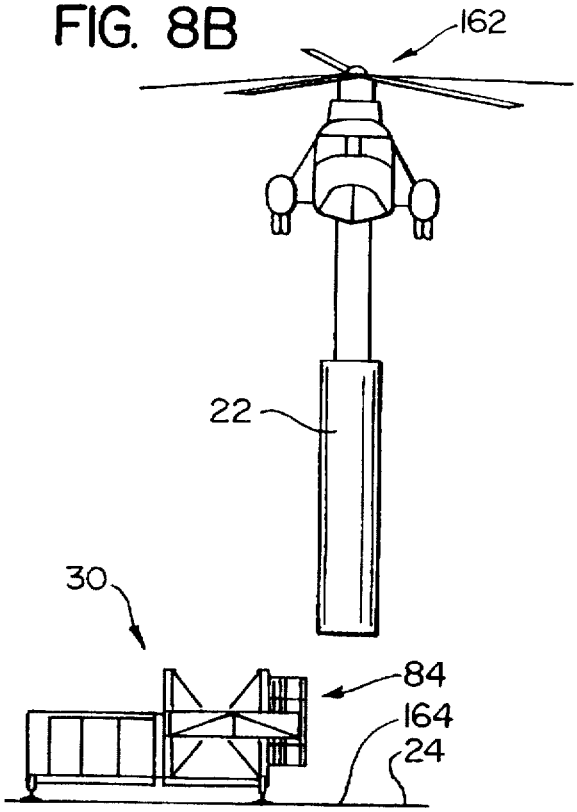

As shown in FIG. 8B, the helicopter 162 is then used to bring the caisson 22 to the desired location 164. Between the steps shown in FIGS. 8B and 8C, the cage assembly 84 is placed around the caisson 22 as described above.

Figure 8C:
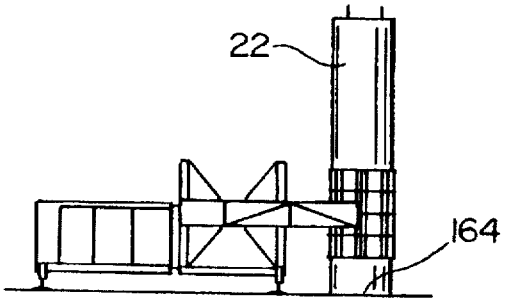
Figure 8D:
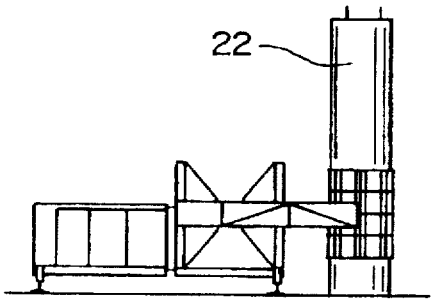
Figure 8E:
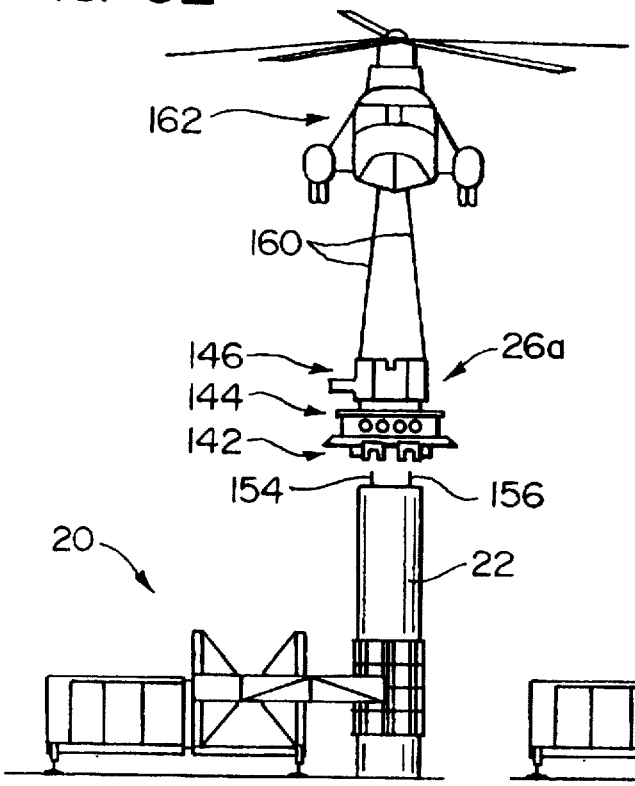

FIG. 8C shows the caisson 22 located at the desired location 164 with the cage assembly 84 in its closed position with the caisson 22 within the cage chamber 114. At this point, the caisson 22 is slightly out of plumb, or vertical alignment, and cannot be driven straight into the earth. Accordingly, between FIGS. 8C and 8D the jacks 38–44 and/or hydraulic assembly 116 are operated as necessary to plumb the caisson 22 as shown in FIG. 8D. Importantly, the helicopter 162 need not be used in this operation.

Referring now to FIG. 8D, that figure depicts the helicopter 162 placing the vibratory portion **26*a* of the vibratory system 26 on to the flanges 154 and 156 located on the upper end of the caisson 22. The clamping assembly 142 is used to fix the vibratory device 144 on to the flanges 154 and 156. The connection between the power pack portion 26*b* and the vibratory portion 26*a* is made and the vibratory assembly 144 is energized to begin driving the caisson 22**.

Figure 8F:
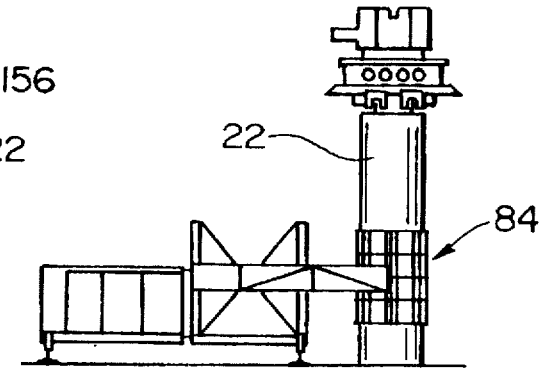
Figure 8G:
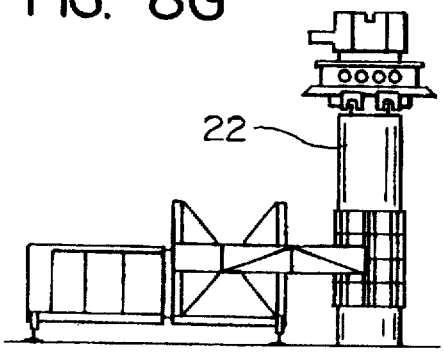

After the pile has been driven a short distance as shown in FIG. 8F, is becomes slightly out of plumb. At this point, the jacks 38–44 and hydraulic assembly 116 are again operated to make the caisson 22 plumb as shown in FIG. 8G.

Figure 8H:
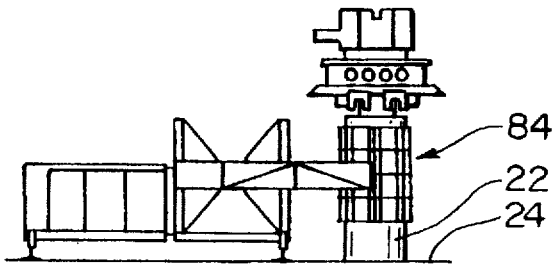

The vibratory device is then operated to drive the caisson 22 to a position where it is partially inserted as shown in FIG. 8H. At this point, the cage assembly 84 is in the way and prevents the caisson 22 from being completely driven into the earth 24.

Figure 8I:
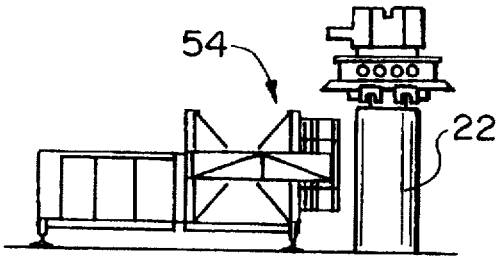

Accordingly, as shown in FIG. 8I, the cage assembly 84 is placed in its open position and the hydraulic assembly 16 operated so that the extension assembly 54 is placed in the retracted position as shown in FIG. 8I. The caisson 22 has been driven far enough that it does not need to be braced in order to maintain it in a plumb configuration.

Figure 8J:
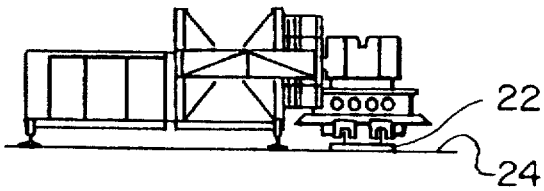
Figure 8K:
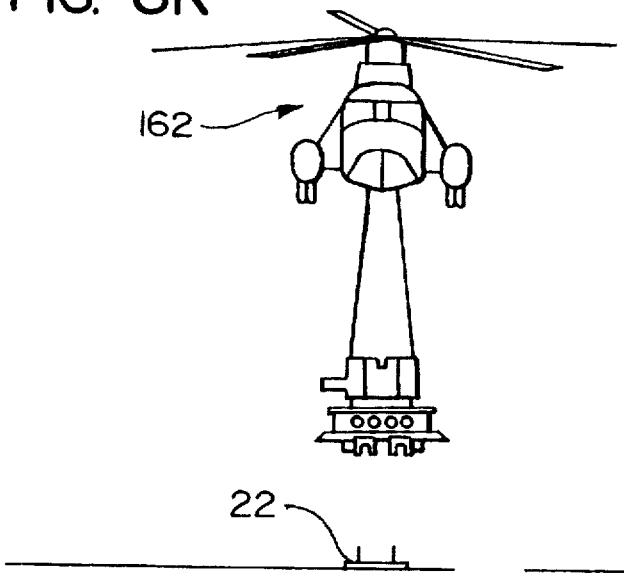
Figure 8L:
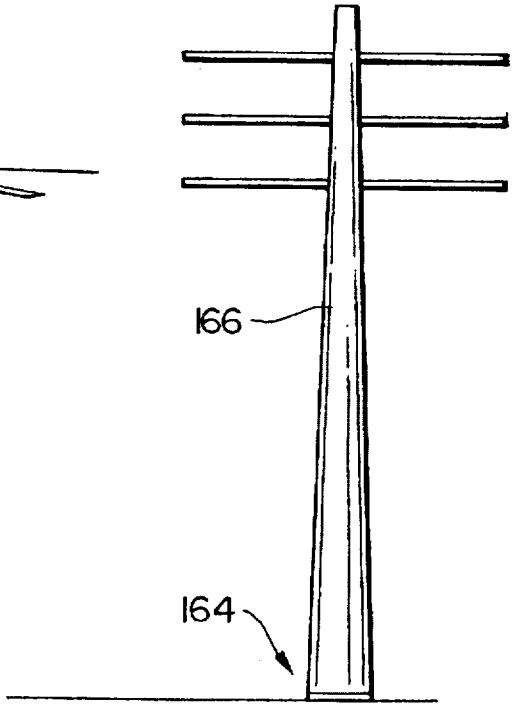

The vibratory device 144 is then operated again to drive the caisson 22 completely into the earth 24 as shown in FIG. 8J. The helicopter 162 is then used to remove the system 20, leaving only the upper end of the caisson 22 exposed. The helicopter 162 then may be used to bring in a power pole 166 which is attached to the caisson 22 at the desired location 164. Because the caisson 22 is plumb, the power pole 166 will be substantially vertical as shown in FIG. 8L.

From the foregoing, it can be seen that system 20 and method of using this system 20 do not require the construction of roads to the desired location 164 and minimizes the use of the helicopter 162. The system 20 and method described herein are thus appropriate for use in locations where the building of a road to the desired location 164 is either impossible or impractical for one reason or another.

The above described embodiment is therefore to be considered in all respects illustrative and not restrictive, the scope of the invention being indicated by the appended claims rather than the foregoing description. All changes that come within the meaning and scope of the claims are intended to be embraced therein.

What is claimed is:

1. A system for driving an elongate member to a desired position in the earth comprising:

vibratory means for generating a vibratory force;

clamp means for fixing at least a portion of the vibratory means to an upper end of the elongate member such that the vibratory means are supported solely by the elongate member;

a structural assembly comprising a support assembly and a bracing assembly; and a ground engaging assembly for spacing the structural assembly from the earth; wherein the bracing assembly initially engages a lower end of the elongate member and solely supports the elongate member and the vibratory means clamped thereto in a desired orientation as the vibratory means applies vibratory forces to the elongate member;

the bracing assembly engages the elongate member such that the vibratory forces move the elongate member into the earth and the earth begins to support the elongate member in the desired orientation;

the bracing assembly is disengaged from the elongate member when the earth is capable of solely supporting the elongate member and the vibratory means; and after the bracing assembly is disengaged from the elongate member, the vibratory means completes driving the elongate member into the earth to the desired position.

2. A system as recited in claim 1, in which the ground engaging assembly comprises adjusting means for moving the structural assembly relative to the ground to move the elongate member into the desired orientation.

3. A system as recited in claim 2, in which the adjusting means comprises at least one jack means for changing a position of the structural assembly relative to the ground.

4. A system as recited in claim 3, in which the adjusting means comprises a plurality of jack means each connected between one of a plurality of points on the structural assembly and the ground such that a distance between the plurality of points on the structural assembly and the ground may be changed to change the orientation of the structural assembly relative to the ground.

5. A system as recited in claim 1, in which the bracing assembly comprises a guide assembly and an extension assembly, where the guide assembly attaches the extension assembly to the support assembly such that the extension assembly may move relative to the support assembly along a first axis but not along second and third axes orthogonal to each other and the first axis.

6. A system as recited in claim 5, further comprising hydraulic means for displacing the extension assembly along the first axis relative to the support assembly.

7. A system as recited in claim 1, in which the bracing assembly comprises a cage assembly adapted to surround a section of the elongate member.

8. A system as recited in claim 7, in which the cage assembly comprises a gate portion movable between a closed position and an open position.

9. A system as recited in claim 1, further comprising means for displacing at least a portion of the bracing assembly along a first axis relative to the support assembly.

10. A system as recited in claim 1, in which the vibratory means comprises a power pack portion and a vibratory portion, where the power pack portion is supported by the support assembly.

11. A system as recited in claim 1, further comprising a connecting assembly for securely attaching the bracing assembly onto the support assembly.

12. A system as recited in claim 11, in which the connecting assembly further comprises:

a plurality of first flange members each defining a first pin opening, where the first flange members are rigidly attached to one of the structural assembly and the support assembly;

a plurality of second flange members each defining a second pin opening, where the second flange members are rigidly attached to the other of the structural assembly and the support assembly; and a plurality of pins each sized and dimensioned to be snugly received within the first and second pin openings; wherein each of the first flange members is associated with one of the second flange members; and when the pins extend into the associated pairs of flange members, the axes of the pins are arranged such that movement between the structural assembly and the fixed portion of the support assembly is prevented.

13. A system as recited in claim 12, in which four pins are provided, and axes of two of the pins lie on a first line and axes of the remaining two pins lie on a second line spaced from the first line.

14. A system for driving an elongate member to a desired position in the earth, comprising:

vibratory means for generating a vibratory force;

clamp means for fixing at least a portion of the vibratory means to an upper end of the elongate member such that the elongate member solely supports the vibratory means;

a support assembly;

a bracing assembly adapted to engage the elongate member;

a connecting assembly adapted to mount the bracing assembly onto the support assembly to form a structural assembly, where the connecting assembly moves the bracing assembly relative to the support assembly; and leveling means for moving the support assembly relative to the ground; wherein when the bracing assembly engages the elongate member, the structural assembly initially engages a lower portion of the elongate member and completely supports the elongate member with the vibratory device attached thereto;

the connecting assembly and leveling means move the bracing assembly to maintain the elongate member in a desired orientation as the elongate member is driven into the ground;

the vibratory means drives the elongate member into the ground with the structural assembly supporting the elongate member and vibratory means in the desired orientation; and when the ground is capable of supporting the elongate member and vibratory means in the desired orientation, the bracing assembly is disengaged from the elongate member and the vibratory means drives the elongate member into the desired position.

15. A system as recited in claim 14, in which the leveling means comprises at least one jack means for changing an orientation of the structural assembly relative to the ground.

16. A system as recited in claim 15, in which the leveling means comprises a plurality of jack means each connected between one of a plurality of points on the structural assembly and the ground such that a distance between the plurality of points on the structural assembly and the ground may be changed to change the orientation of the structural assembly relative to the ground.

17. A system as recited in claim 14, in which the bracing assembly comprises a guide assembly and an extension assembly, where the guide assembly attaches the extension assembly to the support assembly such that the engaging assembly may move along a first axis relative to the support assembly but not along second and third axes orthogonal to each other and the first axis.

18. A system as recited in claim 17, further comprising hydraulic means for displacing the extension assembly along the first axis relative to the support assembly.

19. A system as recited in claim 14, in which the bracing assembly comprises a gate portion movable between a closed position and an open position.

20. A system for driving an elongate member into the earth, comprising:

vibratory means for generating a vibratory force;

clamp means for fixing at least a portion of the vibratory means to the elongate member;

a structural assembly comprising a support assembly and a bracing assembly;

a ground engaging assembly for spacing the structural assembly from the earth; and a connecting assembly for securely attaching the bracing assembly onto the support assembly wherein the bracing assembly engages the elongate member to maintain the elongate member in a desired orientation as the vibratory forces are applied thereto; and the connecting assembly further comprises:

a plurality of first flange members each defining a first pin opening, where the first flange members are rigidly attached to one of the structural assembly and the support assembly;

a plurality of second flange members each defining a second pin opening, where the second flange members are rigidly attached to the other of the structural assembly and the support assembly; and a plurality of pins each sized and dimensioned to be snugly received within the first and second pin openings; wherein each of the first flange members is associated with one of the second flange members; and when the pins extend into the associated pairs of flange members, the axes of the pins are arranged such that movement between the structural assembly and the fixed portion of the support assembly is prevented.

21. A system as recited in claim 20, in which four pins are provided, and axes of two of the pins lie on a first line and axes of the remaining two pins lie on a second line spaced from the first line.

* * * * *